United States Patent [19]

Denison

[11] 4,455,773

[45] Jun. 26, 1984

[54] NON-MAGNETIC LINE GUIDE UNIT FOR COPY HOLDER

[75] Inventor: John F. Denison, Lindenhurst, Ill.

[73] Assignee: Wilson Jones Company, Chicago, Ill.

[21] Appl. No.: 457,724

[22] Filed: Jan. 13, 1983

[51] Int. Cl.[3] ..... B41J 11/64

[52] U.S. Cl. ..... 40/352; 33/437; 40/357

[58] Field of Search ..... 40/352, 357; 33/437, 33/430, 433; 116/240

[56] References Cited

U.S. PATENT DOCUMENTS

| | | | |
|---|---|---|---|
| 1,611,604 | 12/1926 | Martin | 40/352 |
| 1,817,640 | 8/1931 | Newman et al. | 40/352 |
| 1,849,493 | 3/1932 | Larkin | 33/437 |
| 2,442,870 | 6/1948 | Flynn | 40/357 |
| 4,329,799 | 5/1982 | Nagley | 40/352 |

*Primary Examiner*—Gene Mancene
*Assistant Examiner*—Cary E. Stone
*Attorney, Agent, or Firm*—Pennie & Edmonds

[57] ABSTRACT

A line guide holder for support on and selective positioning along a surface to provide marking of a line of written material mounted on a copy holder. The holder is slidably mounted in a groove along one side of the copy holder.

4 Claims, 6 Drawing Figures

NON-MAGNETIC LINE GUIDE UNIT FOR COPY HOLDER

BACKGROUND OF THE INVENTION

Prior arrangements for positioning line guides on copy holders have included magnetic devices magnetically attracted to the copy holder (See U.S. Pat. No. 4,267,656). Other techniques have included guide rollers on a T-square associated with a grooved element attached to a drafting board (U.S. Pat. No. 694,389). Flanges attached to drawing boards have also been disclosed for guiding T-square movement (U.S. Pat. No. 2,451,289).

None of the prior devices provides a satisfactory arrangement without the disadvantage of magnetic elements which can interfere with the operation of nearby equipment.

SUMMARY OF THE INVENTION

Briefly, the invention is directed to a copy holder having an elongated hook track element mounted on its side. A line guide unit is mounted on the side element for slidable movement therealong. The guide unit includes a crooked portion on a base element for mating engagement with the slide element and a line guide arm mounted in a recess in the base element.

It is a feature of the invention that the hook slide element and the crooked portion of the base element are shaped to slidably engage one another in such a way that the crooked portion may be moved to a selected position and it will remain in that position due to forces of friction and torque.

It is a further feature that the crooked portion may be attached with adhesive or other suitable means to the side of copy holders existing in the field.

Figure 1:
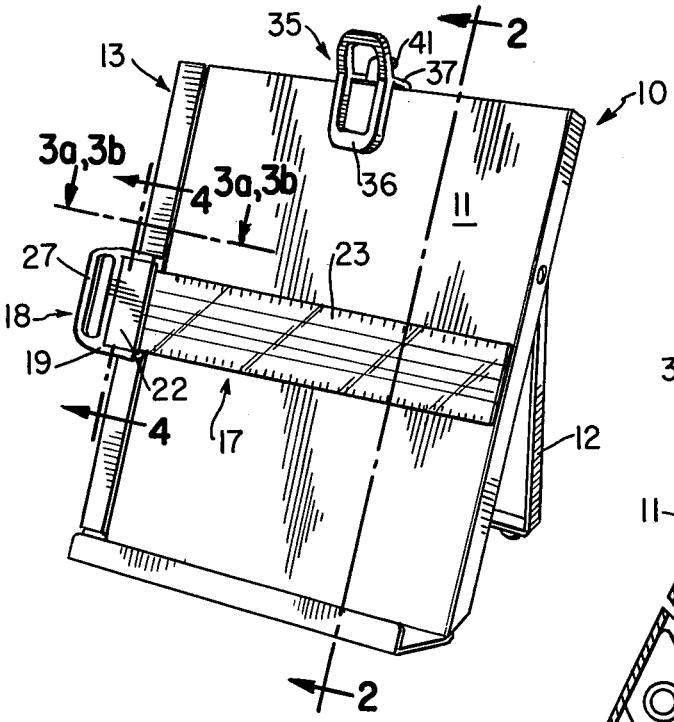
FIG. 1 is a perspective view of the copy holder with the attachable hooked track and line guide unit of this invention.
Figure 4:
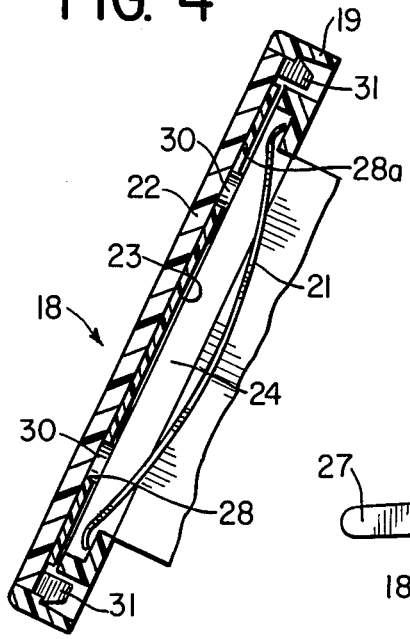

FIGS. *3a*, *3b* are sectional views taken along lines *3a*—*3a*, *3b*—*3b* respectively of FIG. 1;

FIG. 4 is a sectional view taken along line 4—4 of FIG. 1; and

Figure 5:
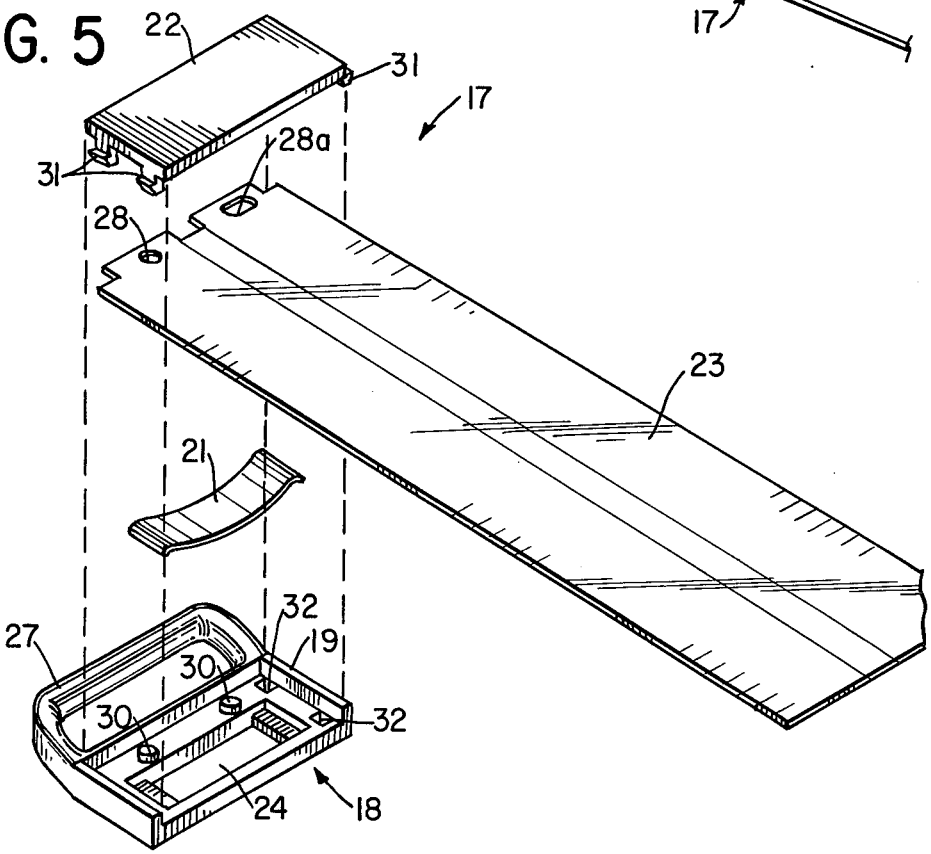

FIG. 5 is an exploded view of the line guide unit.

DESCRIPTION OF THE PREFERRED EMBODIMENT

Figure 2:
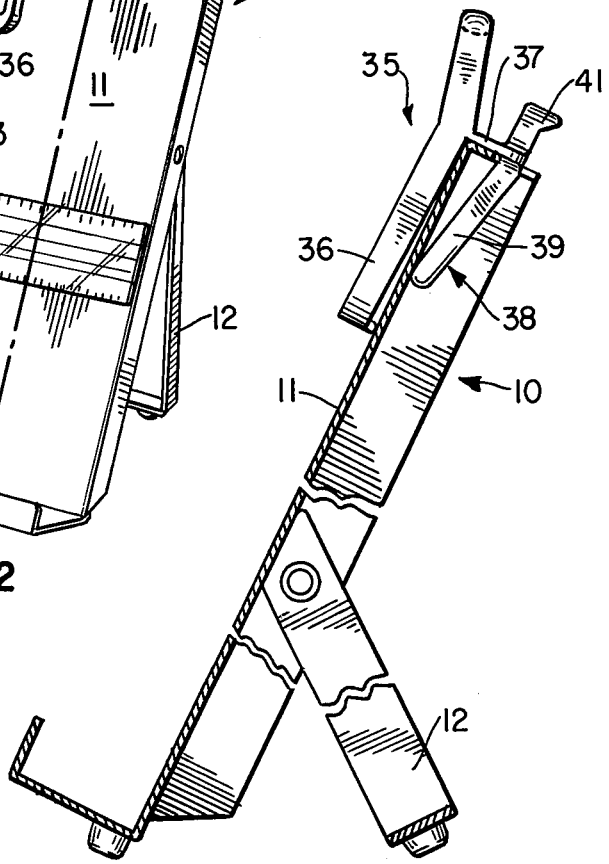
FIG. 2 is a sectional view taken along line 2—2 of FIG. 1.
Figure 3A:
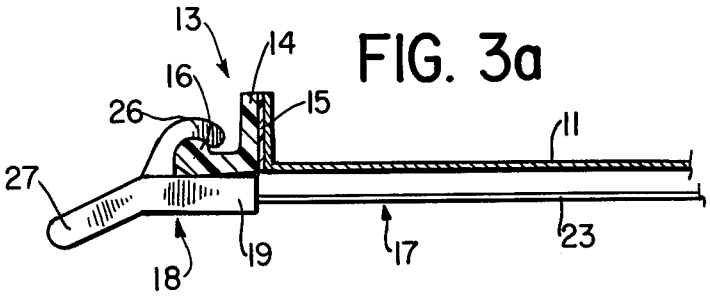
Figure 3B:
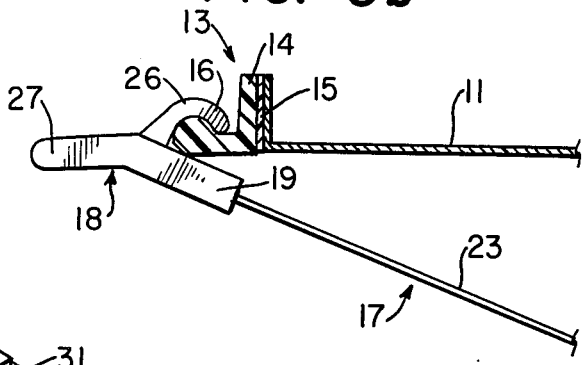

Referring to FIGS. 1, 2 and 3, copy holder 10 includes sheet material support plate 11 for supporting written or printed matter to be held and stand 12 to support the holder in an erected position. Positioned along the left side of support plate 11 is hooked track piece 13. Track piece 13 includes base portion 14 and elongated hook element 16. Track piece 13 is attached to holder 10 through adhesive strip 15. Other attachment means such as screws or clips may be used.

Turning to FIGS. 4 and 5, line guide unit 17 includes mount base 18 which in turn includes housing 19, spring 21, and plate 22. Mounted on mount base 18 is line guide arm 23.

Base 18 includes a recessed partially bottomless chamber 24 in housing 19, a crooked slide portion 26 and handle 27 (See FIG. 3). Crooked portion 26 is shaped to be slid on the end of elongated hook slide element 16 and held thereon in sliding engagement with element 16. Base 18 may be completely removed from element 16 by sliding crooked portion 26 off the upper end of element 16. The operator may grasp handle 27 to move the line guide unit up and down element 16 thereby positioning arm 23 at selected positions. Slide element 16 and crooked portion 26 are shaped so that the line guide unit 17 remains in any position it is moved to due to frictional and torsional forces resulting from spring 21 seated in chamber 24 and partially extending out the bottom of chamber 24 (see FIG. 4). In operation, spring 21 pushes against and is slidably on element 16. The right-hand end of arm 23 may be moved away from plate 11 a short distance, as viewed in FIG. *3b*, to permit removal and replacement of sheet material.

Arm 23 is readily assembled with and attached to unit 17, by means of a round hole 28 and a slotted hole 28*a* which holes 28, 28*a* fit over round projections 30 in chamber 24. Closure plate 22 is then snap fitted into position. Detents 31 engage detent recesses 32 to accomplish the snap fit.

Turning back to FIGS. 1 and 2, clip 35 is mounted on holder 10 for securing sheets thereto. Clip 35 includes front holder piece 36, intermediate piece 37 and back clip portion 38. Clip portion 38 includes holder element 39 and finger piece 41. Holder piece 36 is generally oval in shape and intermediate piece 37 generally perpendiculr to holder piece 36 and back clip portion 38. By moving finger piece 41 toward holder piece 36 clip 35 can be distorted to effect its removal from holder 10.

It is preferred that all parts including clip 35, be made of plastic except spring 21.

I claim:

1. A copy holder for holding sheet material including a face plate having a line guide unit which may be selectively positioned at various positions on the face plate comprising:

an elongated hook slide element attached to one side of the face plate, said hook slide element having a hook element;

a line guide unit positioned for sliding movement on the slide element, said line guide unit in turn comprising a curved crooked element complementarily engaged with the hook element of the slide element;

a housing including a recess; and a recess closure plate for closing the recess; and a line guide arm mounted in said housing recess and held therein by said closure plate to position the arm extending across the face plate.

2. The copy holder of claim 1 in which the line guide unit carrying the arm is pivotable about an axis parallel to the hook slide element to permit the arm to be spaced from the face plate of the copy holder.

3. The copy holder of claim 1 in which the line guide arm engages sheet material on the face plate and having in addition a clip means attached to the face plate to further hold the sheet material.

4. The copy holder of claim 1 in which the line guide arm has holes in its end which holes register with protrusions in the housing recess to align the arm.

* * * * *